US008758026B2

(12) United States Patent
Mueller et al.

(10) Patent No.: US 8,758,026 B2
(45) Date of Patent: Jun. 24, 2014

(54) SYSTEM FOR CONNECTING A FIRST SUBSTRATE TO A SECOND SUBSTRATE

(71) Applicant: Touchsensor Technologies, LLC, Wheaton, IL (US)

(72) Inventors: Donald C. Mueller, Naperville, IL (US); Mark R. Mathews, Lombard, IL (US)

(73) Assignee: Touchsensor Technologies, LLC, Wheaton, IL (US)

( * ) Notice: Subject to any disclaimer, the term of this patent is extended or adjusted under 35 U.S.C. 154(b) by 38 days.

(21) Appl. No.: 13/759,722

(22) Filed: Feb. 5, 2013

(65) Prior Publication Data

US 2013/0203271 A1 Aug. 8, 2013

Related U.S. Application Data

(60) Provisional application No. 61/595,210, filed on Feb. 6, 2012.

(51) Int. Cl.

| | |
|---|---|
| ***H01R 12/00*** | (2006.01) |
| ***H01R 12/70*** | (2011.01) |
| ***H01R 12/73*** | (2011.01) |

(52) U.S. Cl.

CPC ..... *H01R 9/096* (2013.01); *H01R 12/7023* (2013.01); *H01R 12/73* (2013.01)

USPC ..... 439/65

(58) Field of Classification Search

USPC ..... 439/63–75

See application file for complete search history.

(56) References Cited

U.S. PATENT DOCUMENTS

| | | | | |
|---|---|---|---|---|
| 4,927,369 | A | 5/1990 | Grabbe | |
| 5,030,109 | A | 7/1991 | Dery | |
| 5,061,191 | A | 10/1991 | Casciotti et al. | |
| 5,232,372 | A | 8/1993 | Bradley | |
| 5,273,438 | A | 12/1993 | Bradley et al. | |
| 5,913,687 | A | 6/1999 | Rathburn | |
| 6,439,894 | B1 | 8/2002 | Li | |
| 6,666,690 | B2 | 12/2003 | Ishizuka | |
| 6,958,616 | B1 | 10/2005 | Mahoney | |
| 7,011,555 | B2 * | 3/2006 | Pan | 439/862 |
| 7,070,419 | B2 | 7/2006 | Brown et al. | |
| 7,874,845 | B1 * | 1/2011 | Tang et al. | 439/65 |
| 8,152,535 | B2 * | 4/2012 | Ihara | 439/66 |
| 8,414,307 | B2 * | 4/2013 | Que et al. | 439/65 |
| 2003/0003784 | A1 | 1/2003 | Neidich | |
| 2004/0002234 | A1 | 1/2004 | Masao | |

* cited by examiner

*Primary Examiner* — Chandrika Prasad

(74) *Attorney, Agent, or Firm* — Barnes & Thornburg LLP

(57) ABSTRACT

An interconnect apparatus for interconnecting electrical components includes a body and a spring element retained by and extending from the body. The apparatus is configured so that a portion thereof may be captured between first and second substrates and to connect electrical circuits lying in different planes.

14 Claims, 5 Drawing Sheets

SYSTEM FOR CONNECTING A FIRST SUBSTRATE TO A SECOND SUBSTRATE

BACKGROUND OF THE INVENTION

Some electronic assemblies include circuits disposed on separate circuit carriers. The carriers and/or the circuits disposed thereon can lie in different planes. For example, touch screens typically involve an ultra-thin array of sensing electrodes disposed on a glass or plastic touch substrate. The sensing electrodes can be printed or otherwise disposed directly on the touch substrate, or they can be disposed on a thin, typically flexible, intermediate carrier that, in turn, is disposed on the touch substrate. The sensing electrodes terminate at or otherwise are connected to bonding pads to enable connection of the sensing electrodes to a control circuit. The control circuit typically is located on another substrate, for example, a printed wiring board, that is attached to or otherwise associated with the touch substrate. Portions of the control circuit to be connected to the sensing electrodes also terminate at or otherwise are connected to bonding pads to enable connection of the control circuit to the sensing electrodes.

The control circuit substrate could be attached to the touch substrate adjacent the array of sensing electrodes. However, because the thickness of the control circuit substrate typically is substantially greater than the thickness of the sensing electrodes and any intermediate carrier they might be disposed on, the bonding pads connected to the sensing electrodes typically lie in a substantially different plane than do the bonding pads connected to the control circuit. As such, the respective bonding pads may lie at substantially different perpendicular distances from the surface of the touch substrate upon which they or their respective carriers/substrates are disposed. Conventional means for interconnecting bonding pads located in different planes often are difficult to realize.

DETAILED DESCRIPTION OF THE DRAWINGS

Figure 1:
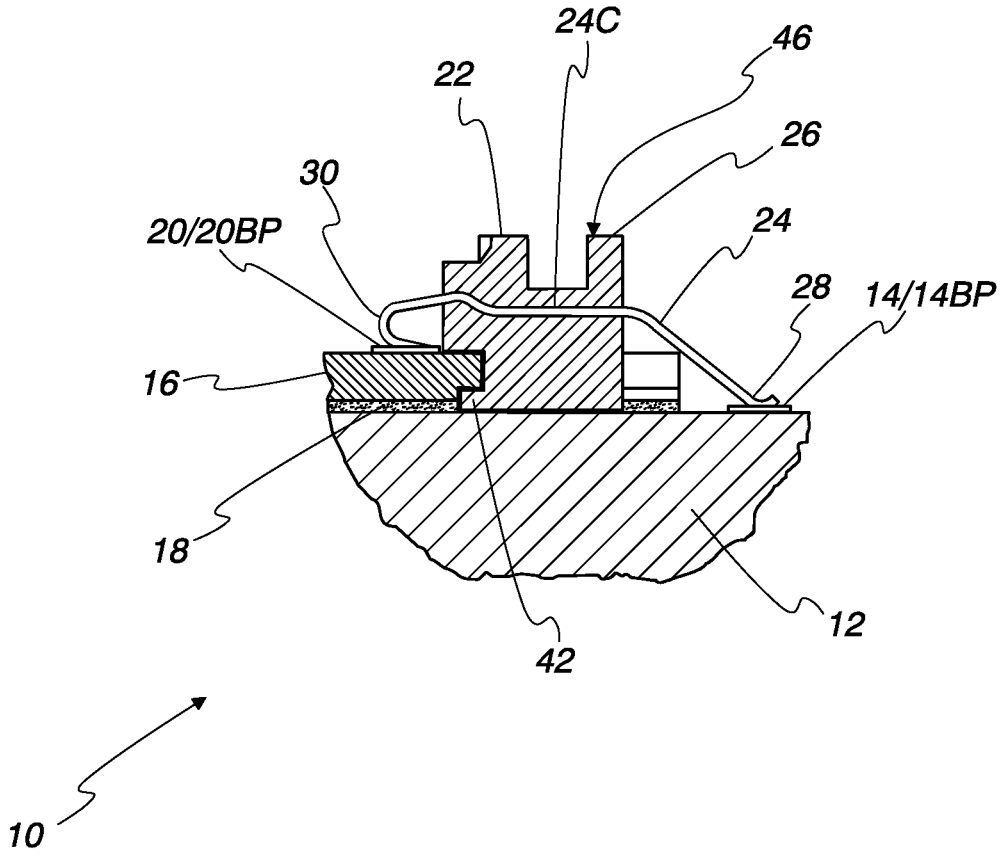
FIG. 1 is a side elevation view of an illustrative system 10 including a first substrate 12, a first circuit 14 disposed on first substrate 12, a second substrate 16 in the form of a printed circuit board attached to first substrate 12 via adhesive layer 18, a second circuit 20 disposed on second substrate 16, and an illustrative interconnect apparatus 22 having a conductive spring 24 electrically connecting second circuit 20 to first circuit 14.
Figure 2:
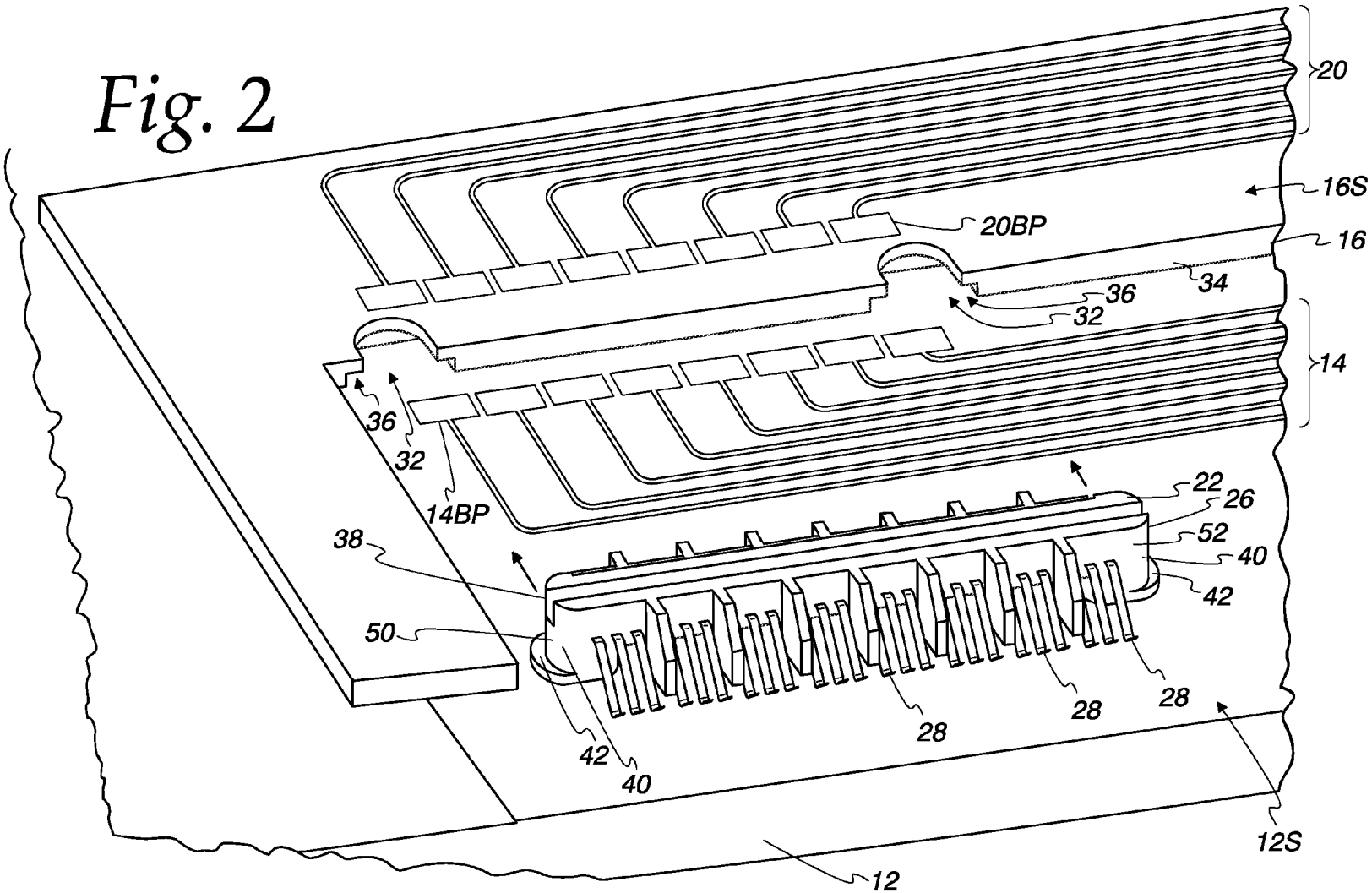
FIG. 2 is an exploded perspective view of system 10 including first substrate 12, printed circuit board 16, and interconnect apparatus 22.

FIGS. 1 and 2 illustrate a system 10 including a first substrate 12 bearing a first circuit 14 on a first (or upper) surface 12S thereof and a second substrate 16 bearing a second circuit 20 on a first (or upper) surface 16S thereof. (The terms "upper" and "lower" as used herein generally are intended to indicate relative location and should not be interpreted as setting forth absolute spatial limitations unless the context clearly indicates otherwise.) System 10 also includes an interconnect apparatus 22 having a body 26 and a plurality of conductive spring elements 24 extending from body 26. Body 26 is mechanically engaged with at least one of first substrate 12 and second substrate 16, and spring elements 24 are mechanically and electrically engaged with portions of first circuit 14 and portions of second circuit 20, thereby electrically connecting such portions of first circuit 14 and portions of second circuit 20.

First substrate 12 and second substrate 16 could be made of any material or materials suitable for use as an electrical circuit platform, as would be understood by one skilled in the art. For example, first substrate 12 could be a printed wiring board made of FR4 or another material, a flexible circuit carrier or a piece of glass or plastic forming a portion of a touch screen assembly, another form of user interface or a circuit platform. Second substrate 16 could be embodied in any of the foregoing forms. In an illustrative embodiment, at least a portion of surface 12S and at least a portion of surface 16S are substantially planar. Either or both of first substrate 12 and second substrate 16 could be embodied in numerous other ways and made of other materials, as would be recognized by one skilled in the art.

First circuit 14 could be disposed directly first substrate 12 in any suitable form and using any suitable technique. For example, first circuit 14 could be an array of sensing electrodes connected directly or indirectly to one or more bonding pads 14BP. Bonding pads 14BP could, but need not, be disposed on a substantially planar portion of surface 12S of first substrate 12. Alternatively or additionally, first circuit 14 could include other electrical/electronic components (not shown) and electrical traces (not shown), among other elements.

First circuit 14 could be formed by printing conductive ink directly onto first substrate 12, by plating, patterning and etching first substrate 12, or by other suitable means, as would be understood by one skilled in the art. In other embodiments, first circuit 14 could take other forms, and it could be disposed on first substrate 12 in other ways, as would be understood by one skilled in the art. For example, first circuit 14 could be disposed an intervening circuit carrier (not shown) that would, in turn, be disposed on first substrate 12. Such an intervening circuit carrier could be made of any suitable material, for example, flexible polyester or any other material suitable for use as a circuit carrier, as would be recognized by one skilled in the art. It could be attached to first substrate 12 using an adhesive or other suitable means.

Second circuit 20 could be disposed directly or indirectly on second substrate 16 in any suitable form and using any suitable technique, for example, any of the forms and techniques discussed above. Second circuit 20 could include, for example, bonding pads 20BP, electrical traces (not shown) and various electrical/electronic components (not shown), among other components. Bonding pads 20BP could, but need not, be disposed on a substantially planar portion of surface 16S of second substrate 16.

FIGS. 1 and 2 illustrate second substrate 16 attached to first substrate 12 using an adhesive layer 18. In other embodiments, second substrate 16 could be attached to or otherwise associated with first substrate 12 in other ways. For example, second substrate 16 could be attached to first substrate 12 using mechanical fasteners, interference geometry or other suitable means. In an illustrative embodiment, a second (or lower) surface 16S' of second substrate 16 abuts or is adjacent to first surface 12 of first substrate 12. In such an embodiment, second surface 16S' of second substrate 16 preferably would be generally opposite and parallel to surface 16S of second substrate 16.

FIGS. 1 and 2 also illustrate second substrate 16 oriented with respect to first substrate 12 such that first circuit 14 and second circuit 20 lie in substantially different planes and such that bonding pads 14BP and 20BP lie at substantially different perpendicular distances from surface 12S of first substrate 12. In other embodiments, first substrate 12 could be oriented with respect to second substrate 16 such that first circuit 14 and second circuit 20 lie substantially in the same plane and/or such that bonding pads 14BP and 20BP lie at substantially the same perpendicular distance from surface 12S of first substrate 12. FIGS. 1 and 2 further illustrate the portions (for example, bonding pads 14BP and 20BP, respectively) of first circuit 14 and second circuit 20 to be interconnected as being laterally separated such that the interconnection points do not overlie each other. Put another way, bonding pads 20BP do not overlie bonding pads 14BP. In other embodiments, the interconnection points of first circuit 14 and second circuit 20 could overlie each other. For example, in such an embodiment, bonding pads 20BP and/or second substrate 16 could partially or completely overlie bonding pads 16BP.

Figure 5:
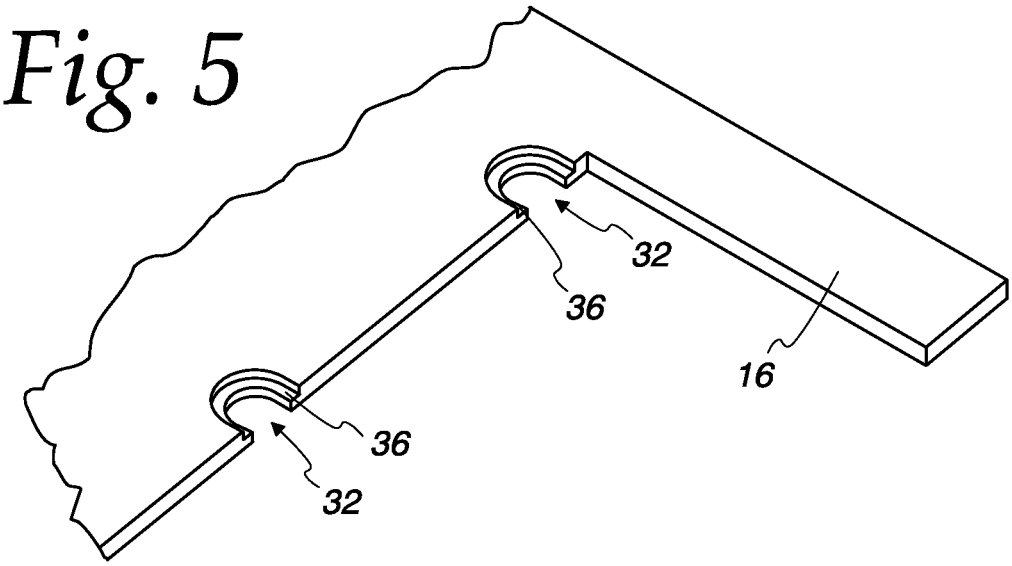
FIG. 5 is a perspective view of the underside of printed circuit board 16 showing slots 32 and countersunk portions 36.

As best illustrated in FIGS. 2 and 5, second substrate 16 defines two slots 32 extending inwardly from free edge 34 thereof. Each of slots 32 includes a countersunk portion (or undercut) 36 extending inwardly from second surface 16S' thereof. The surface of undercut 36 facing upper surface 12S of first substrate 12 typically would be, but need not be, parallel to upper surface 12S and to lower surface 16S' of second substrate 16.

Undercuts 36 provide clearance for the foot or flange 42 of body 26, as will be discussed further below. In embodiments wherein sufficient clearance exists between first substrate 12 and second substrate 16 to receive foot or flange 42 of body 26 therebetween, as discussed further below, undercut 36 could be omitted. Such clearance could be provided by means of shims or spacers (for example, a sufficiently thick adhesive layer 18) disposed between first substrate 12 and second substrate 16.

Slots 32 and/or countersunk portions 36 could be molded or machined into second substrate 16. In other embodiments, second substrate 16 could define more or fewer than two slots 32 and countersunk portion 36 could be embodied in other forms. In further embodiments, one or more slots similar to slots 32 could be defined by another substrate or structure (not shown), for example, a stand off attached to first substrate 12 and adapted to receive or retain a portion of interconnect apparatus 22. Such structure could, but need not, include an undercut similar to undercut 36. In embodiments including such a stand off or similar structure, slots 32 and countersunk portions 36 need not be provided in second substrate 16.

Figure 3:
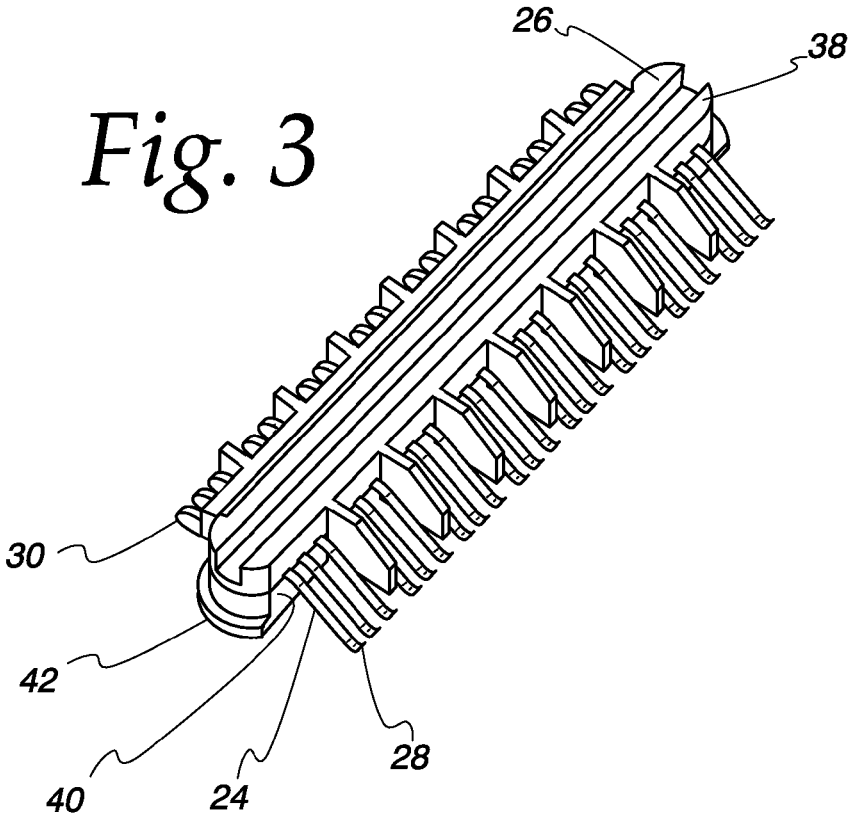
FIG. 3 is a perspective view of interconnect apparatus 22 including a body 26 having a body portion 38 and a base portion 40 with a flange 42 extending therefrom, and conductive springs 24 having first ends 28 and second ends 30 extending from body 26 and a center portion engaged within body 26.
Figure 4:
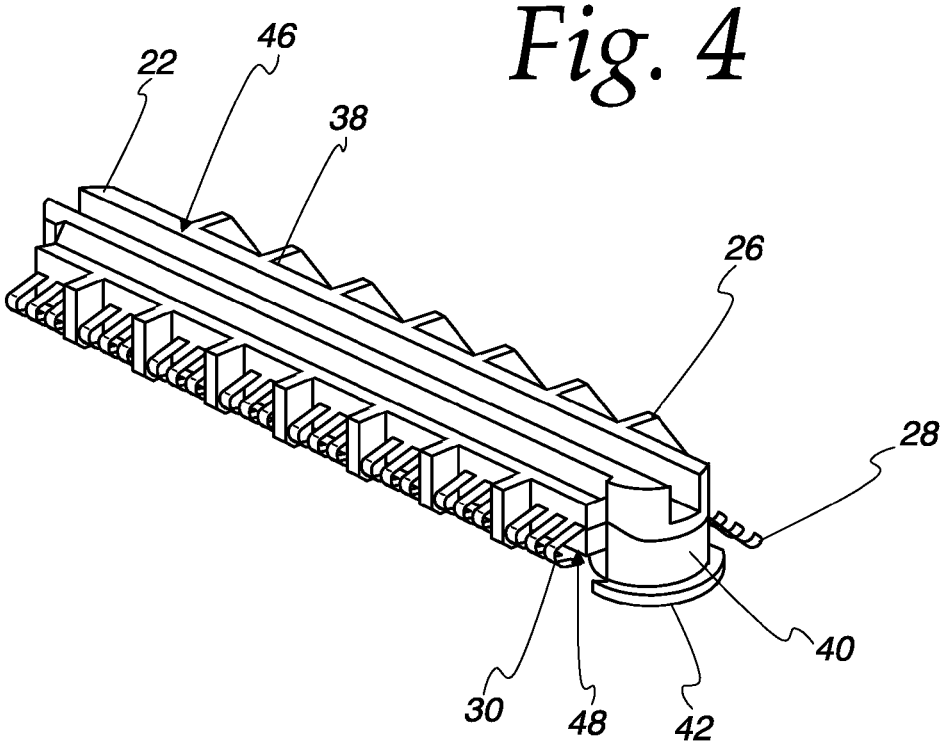
FIG. 4 is another perspective view of interconnect apparatus 22 including conductive springs 24 and body 26.

As discussed above and illustrated in FIGS. 1-4 and 7, interconnect apparatus 22 includes a body 26 and conductive spring elements 24 extending therefrom. Body 26 can be made of any suitable material having suitable dielectric properties, for example, a plastic material, as would be understood by one skilled in the art. Spring elements 24 can be made of any material having suitable electrical conductivity, flexibility and resiliency, as would be understood by one skilled in the art. In the embodiment shown in FIGS. 3 and 4, interconnect apparatus 22 includes twenty-four spring elements 24. In other embodiments, interconnect apparatus 22 could have more or fewer (as few as one) spring elements 24.

In the illustrated embodiment, body 26 includes a generally elongated core portion 38 having an upper side 46, a lower side 48, a first end 50 and a second end 52. A first leg 40 depends generally perpendicularly from lower side 48 of core portion 38 at or near first end 50 thereof, and a second leg 40 depends generally perpendicularly from lower side 48 of core portion 38 at or near second end 52 thereof. In other embodiments, core portion 38 could have other shapes, and legs 40 could depend from other regions of core portion 38, and in other orientations. For example, legs 40 could depend from regions of core portion 38 intermediate first and second ends 50, 52 thereof. Also, legs 40 could depend from core portion 38 in an angular orientation or another orientation not generally perpendicular to core portion 38. A foot or flange 42 extends laterally from the free end of each leg 40.

Each leg 40 is configured such that at least a portion thereof may be received by a corresponding slot 32 of second substrate 16. Also, each foot or flange 42 is configured such that at least a portion thereof may be received by a corresponding countersunk portion 36 of second substrate 16. More particularly, at least a portion of each leg 40 can be inserted into a corresponding slot 32, and at least a portion of each foot 42 can be inserted into countersunk portion 36 such that the flange 42 is disposed between upper surface 12S of first substrate 12 and countersunk portion 36 of second substrate 16, thereby holding interconnect apparatus 22 in place. In embodiments not including countersunk portion 36, as discussed above, each foot or flange 40 could simply be disposed between upper surface 12S first substrate 12 and lower surface 16S' of second substrate 16.

In embodiments having slot structure and countersunk portions independent of second substrate 16, as discussed above, legs 40 and feet 42 of body 26 could be mechanically engaged with such structure instead of with second substrate 16.

Figure 6:
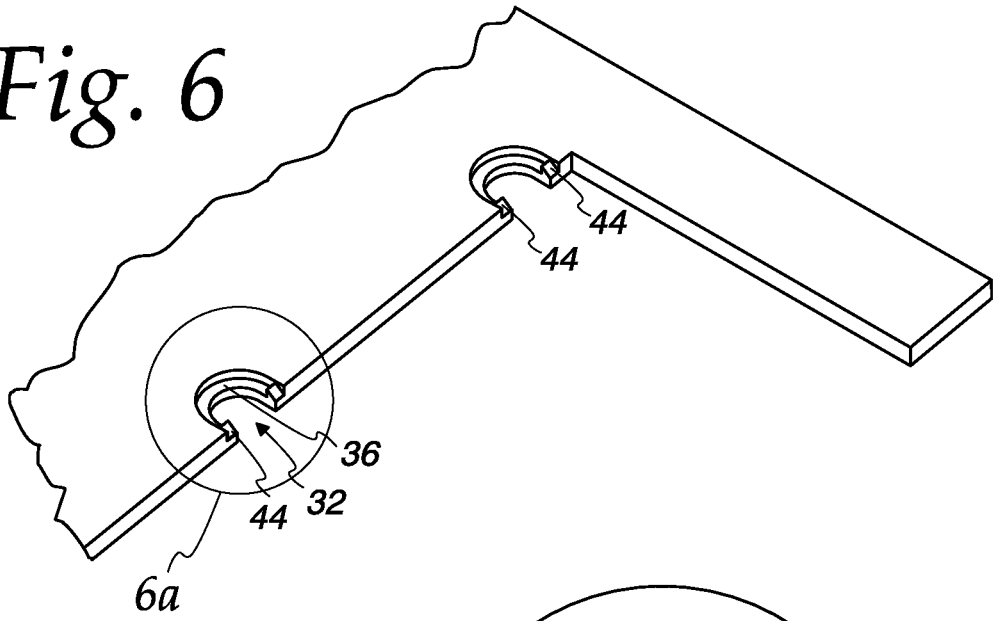
FIG. 6 is another perspective view of the underside of printed circuit board 16 showing ramp/retention structure 44.
Figure 6A:
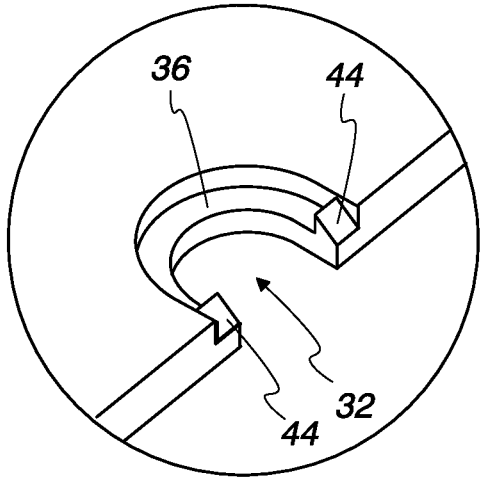
FIG. 6*a* is a detail view of a portion of FIG. 6.
Figure 7:
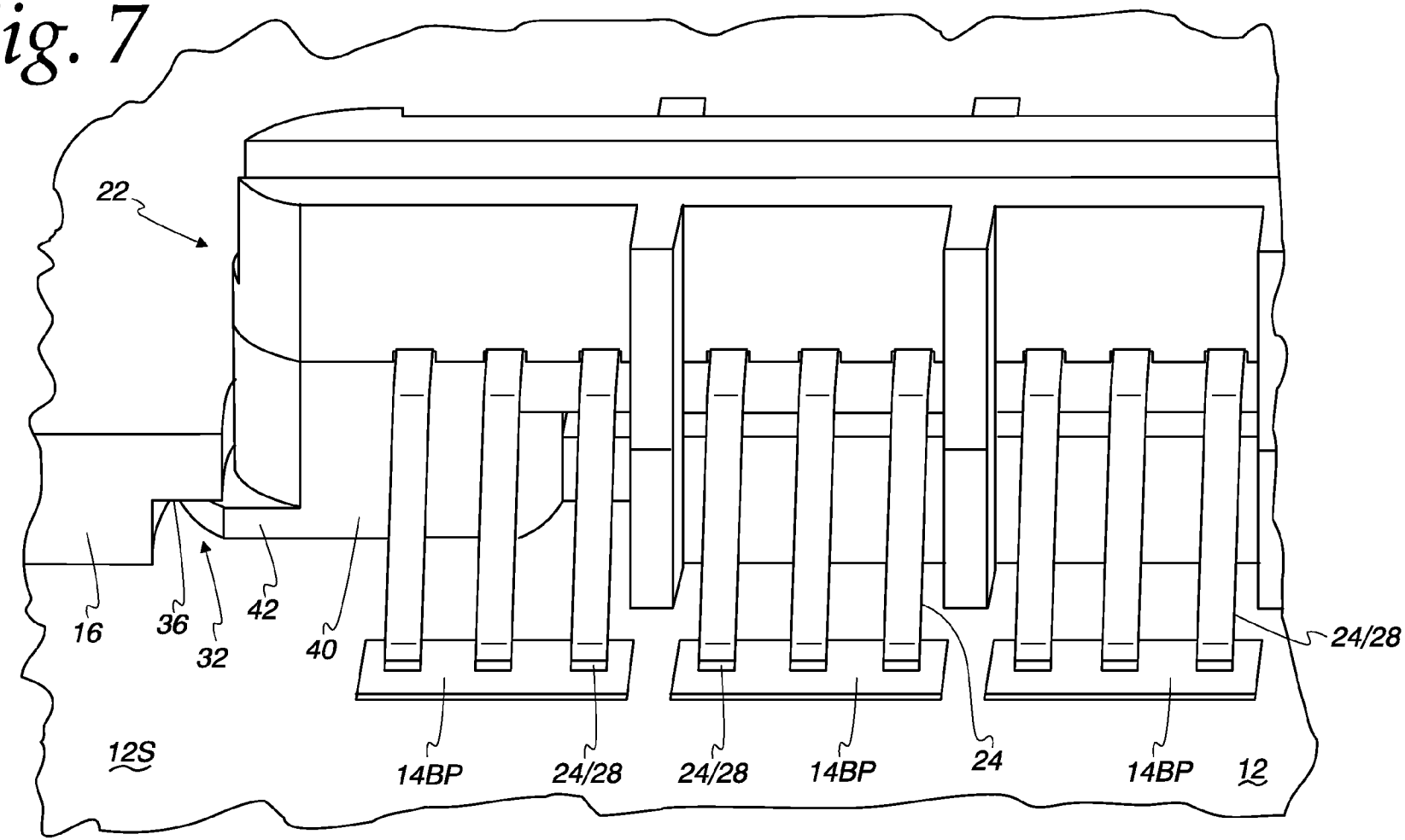
FIG. 7 is an isometric view showing a flange 42 extending from a foot 40 of interconnect apparatus 22 engaged between an upper surface 12S of first substrate 12 and countersunk portion 36 of an underside of second substrate 16, and further showing first ends 28 of spring members 24 engaged with bonding pads 12BP on first substrate 12.

Snap geometry, for example, ramps 44 as shown in FIG. 6, can be provided to secure interconnect apparatus 22 in place between first and second substrates 12 and 16. Alternatively, friction or interference geometry, for example, the friction between foot 40 and slot 32, the friction between foot 42 and first and/or second substrates 12, 16, or the friction between springs 24 and bonding pads 14BP and/or 20BP, as discussed further below, may be sufficient to secure interconnect apparatus 22 in place. In such embodiments, ramps 44 or other snap geometry could be omitted.

As discussed above, spring elements 24 extend from body 26. Each spring element 24 has a center section 24C, a first end section 28 extending outwardly from one end of center section 24C, and a second end section 30 extending outwardly from the other end of center section 24C. Center section 24C is retained by or connected to core portion 38 of body 26, and first and second end sections 28, 30 extend outwardly from core portion 38 of body 26. Core portion 38 could retain center section 24C in any number of ways. For example, core portion 38 could be partially or completely molded about center section 24C, or core portion 38 could be formed in two or more pieces that are post-assembled about center section 24C. Alternatively, center portion 24C could be connected to upper or lower side 46, 48 of core 38 using screws, rivets or other fasteners, or by another suitable technique, as would be recognized by one skilled in the art.

First end section 28 includes a first contact point 28CP. First contact point 28CP may be located at or near the terminal end of first end section 28 or at another point between the terminal end thereof and center section 24. First end section 28 and first contact point 28CP are configured so that first contact point 28CP can make good electrical contact with an applicable portion, for example, bonding pad 14BP, of first circuit 14, as discussed further below. Similarly, second end section 30 includes a second contact point 30CP. Second contact point 30CP may be located at or near the terminal end of second end section 30 or at another point between the terminal end thereof and center section 24. Second end section 30 and second contact point 30CP are configured so that second contact point 3CP can make good electrical contact with an applicable portion, for example, bonding pad 20BP, of second circuit 20, as discussed further below.

The lengths and geometry of first and second end sections 28, 30 of springs 24 can be selected as desired for a particular application. For example, first and second end sections 28, 30 of spring elements 24 could have different lengths and extend from body 26 at different angles or in different orientations in order to facilitate engagement of spring elements 24 with circuits 14, 20 disposed on substrates 12, 16.

Also, the terminal ends of first and second end sections 28, 30 of spring elements 24 could be bent back upon themselves or in a dog-leg manner as shown in FIGS. 1-4 and 7. Forming the terminal ends in such a manner could allow for easier assembly and/or disassembly of interconnect apparatus 22 to/from first and second substrates 12, 16. For example, such configurations could enable first and second end sections 28, 30 of springs 24 to more easily ride over solder joints or other variations in the surface geometry of substrates 12, 16 or components or materials disposed thereon. Contact points 28CP, 30CP could be formed by forming the terminal ends in such a manner. The terminal ends could have other suitable configurations, as well, to better effect this function or other functions.

The embodiments disclosed herein are merely illustrative, and they are not to be deemed to limit the scope of the present invention. One skilled in the art would recognize how to modify the disclosed embodiments or implement alternative embodiments without departing from the scope of the invention as defined in the claims below.

The invention claimed is:

1. A system comprising:

a first substrate;

a first bonding pad disposed on a surface of said first substrate;

a second substrate;

a second bonding pad disposed on a surface of said second substrate;

said second substrate attached to said surface of said first substrate;

said second substrate having an edge, and defining:

a first slot extending inwardly from said edge; and a second slot extending inwardly from said edge; and a body comprising:

a core portion;

a first leg extending from said core portion;

a first flange extending from said first leg;

a second leg extending from said core portion;

a second flange extending from said second leg;

a spring element having a center section, a first end section and a second end section, said center section connected to said body, and said first end section and said second end section extending from said body;

at least a portion of said first leg received by said first slot and at least a portion of said first flange engaged with said second substrate;

at least a portion of said second leg received by said second slot and at least a portion of said second flange engaged with said second substrate;

said first end section of said spring element electrically connected to said first bonding pad and said second end section of said spring element electrically connected to said second bonding pad.

2. The system of claim 1 wherein said second substrate is attached to said surface of said first substrate such that said first bonding pad is at a first perpendicular distance from said surface of said first substrate and said second bonding pad is at a second perpendicular distance from said surface of said first substrate, said second perpendicular distance being different from said first perpendicular distance.

3. The system of claim 1, said second substrate defining a first undercut associated with said first slot, said first undercut disposed between said first substrate and said second substrate, and said first flange engaged with said first undercut.

4. The system of claim 3, said second substrate further defining a second undercut associated with said second slot, said second undercut disposed between said first substrate and said second substrate, and said second flange engaged with said second undercut.

5. The system of claim 4 wherein said spring element is retained by said body.

6. The system of claim 4 further comprising a fastener connecting said spring element to said body.

7. The system of claim 4 wherein said first flange is engaged with said first substrate and said first undercut, and said second flange is engaged with said first substrate and said second undercut.

8. The system of claim 4, said body comprising a plurality of spring elements, each said spring element having a center section, a first end section and a second end section, said center section connected to said body, and said first end section and said second end section extending from said body.

9. A system comprising:

a first substrate;

a first bonding pad disposed on a surface of said first substrate;

a second substrate;

a second bonding pad disposed on a surface of said second substrate;

said second substrate attached to said surface of said first substrate;

a body comprising:

a core portion;

a first leg extending from said core portion;

a first flange extending from said first leg;

a second leg extending from said core portion;

a second flange extending from said second leg;

a spring element having a center section, a first end section and a second end section, said center section connected to said body, and said first end section and said second end section extending from said body; and a first stand-off attached to said first substrate and a second stand-off attached to said first substrate, said first stand-off comprising a surface having an edge and defining a first slot extending inwardly from said edge, and said second stand-off comprising a surface having an edge and defining a second slot extending inwardly from said edge, at least a portion of said first leg received by said first slot and at least a portion of said first flange engaged with said first standoff, and at least a portion of said second leg received by said second slot and at least a portion of said second flange engaged with said second standoff;

said first end section of said spring element electrically connected to said first bonding pad and said second end section of said spring element electrically connected to said second bonding pad.

10. The apparatus of claim 1 wherein said surface of said first substrate lies in a first plane and said surface of said second substrate lies in a second plane, said first plane being substantially parallel to said second plane.

11. The system of claim 9 wherein said second substrate is attached to said surface of said first substrate such that said first bonding pad is at a first perpendicular distance from said surface of said first substrate and said second bonding pad is at a second perpendicular distance from said surface of said first substrate, said second perpendicular distance being different from said first perpendicular distance.

12. The system of claim 9, wherein said spring element is retained by said body.

13. The system of claim 12 further comprising a fastener connecting said spring element to said body.

14. The system of claim 12, said body comprising a plurality of spring elements, each said spring element having a center section, a first end section and a second end section, said center section connected to said body, and said first end section and said second end section extending from said body.

* * * * *